United States Patent [19]

Hope et al.

[11] 4,327,989

[45] May 4, 1982

[54] DRIVE MECHANISM FOR PHOTOGRAPHIC FILM AND PAPER PROCESSING MACHINE

[76] Inventors: Henry F. Hope; Stephen F. Hope, both of 2421 Wyandotte Rd., Willow Grove, Pa. 19090

[21] Appl. No.: 62,990

[22] Filed: Aug. 2, 1979

[51] Int. Cl.[3] ..... G03D 3/08

[52] U.S. Cl. ..... 354/322; 134/122 P; 74/421 R

[58] Field of Search ..... 354/316, 319, 320, 321, 354/322; 134/122 P, 64 P; 74/416, 421 R; 308/26, 37, 238

[56] References Cited

U.S. PATENT DOCUMENTS

| | | | |
|---|---|---|---|
| 1,778,452 | 10/1930 | Ernst | 308/37 |
| 2,541,353 | 2/1951 | Goetz et al. | 134/122 P |
| 2,913,974 | 11/1959 | Sabel et al. | 354/322 |
| 3,287,013 | 11/1966 | Fairbanks et al. | 354/319 |
| 3,318,642 | 5/1967 | Peterson | 308/26 |
| 3,532,048 | 10/1970 | Hope et al. | 354/320 |
| 3,601,459 | 8/1971 | Cutting | 308/26 |
| 4,003,512 | 1/1977 | Mori | 354/321 |
| 4,026,451 | 5/1977 | Hope et al. | 354/320 |
| 4,086,607 | 4/1978 | Muller | 134/122 P |
| 4,089,566 | 5/1978 | Schmidt | 308/26 |
| 4,118,998 | 10/1978 | Hope et al. | 74/421 R |
| 4,135,312 | 1/1979 | Hope et al. | 34/155 |
| 4,150,589 | 4/1979 | Hope et al. | 74/421 R |

*Primary Examiner*—L. T. Hix
*Assistant Examiner*—Alan Mathews
*Attorney, Agent, or Firm*—Zachary T. Wobensmith, 2nd; Zachary T. Wobensmith, III

[57] ABSTRACT

A drive mechanism is disclosed for photographic film and paper processing machines employing a plurality of processing tanks in succession and with roller transports therein for the film and paper, as well as for other components of film processing machines including area measuring apparatus and driers for the film and paper, which drive mechanism eliminates the necessity for careful alignment of the transverse drive shafts for the respective components, the transverse drive shafts for each of the components preferably being loosely pivotally mounted in the frame of the component at one end and loosely carried in the frame of the component at the other end, with provisions associated with the main frame of the machine for retention of the transverse drive shafts, a drive gear mounted on each transverse drive shaft meshing with a worm gear mounted on a longitudinal drive shaft which is supported by the machine frame at spaced locations along its length.

9 Claims, 6 Drawing Figures

DRIVE MECHANISM FOR PHOTOGRAPHIC FILM AND PAPER PROCESSING MACHINE

BACKGROUND OF THE INVENTION

1. Field of the Invention

This invention relates to a drive mechanism for photographic film and paper processing machines.

2. Description of the Prior Art

It has heretofore been proposed to provide processing apparatus for photographic film and paper having a plurality of separate components for successive processing, including but not limited to developing, fixing, washing and drying, the components for developing, fixing and washing preferably including tanks with removably mounted roller transports or conveyor mechanisms including turnaround devices therein.

One such machine is shown in our prior U.S. Pat. No. 3,532,048. The driving of the roller transfer or conveyor mechanism requires a power input for each roller transport. In this construction, trains of gears are provided which require accurate positioning of their shafts. It has been common practice to mount said transverse input shafts for roller transport racks in end frame plates of the roller transport racks. Specific examples are shown in U.S. Pat. Nos. 4,026,451; 4,150,589 and 4,118,998.

It has also been proposed to employ a longitudinally disposed motor driven input shaft with spaced worm gears thereon for simultaneously driving the transverse input shafts for the respective components. This has been very difficult to effectively achieve in practice because of the irregularities in heights of the longitudinal shaft and the transverse input shafts with interengaging gears on these shafts. It is of course highly desirable, if not essential, to maintain uniformity of speed of the strips through the various components including from one tank to the next and during their entire transport through the machine.

The present drive mechanism is simple to install, avoids the necessity for precise placing of a longitudinal drive shaft and the transverse input shafts, and automatically causes the drive gear to seat correctly in the worm, permits of easy removal of the components and has other advantages.

SUMMARY OF THE INVENTION

In accordance with the invention a drive mechanism is provided for the components of film and paper processing machines, including but not limited to roller transports for treating tanks, for developing, fixing and washing, as well as other components, which utilizes a longitudinally disposed shaft carried by the frame of the machine with a spaced worm gear for each component, the components to be driven having transverse shafts loosely pivotally mounted at one end in an end frame of the component and at the other end being loosely carried in another end frame each with a driving gear meshing with the worm gear.

It is the principal object of the invention to provide an improved drive mechanism for the components of a photographic film and paper processing machine which is reliable in its operation, and which is easy and inexpensive to install and provides extremely accurate self aligning gear mesh.

It is a further object of the invention to provide an improved drive for the components of photographic film and paper processing machines in which the components, including roller transports and driers can be readily removed for inspection and maintenance.

It is a further object of the invention to provide an improved drive for the components of photographic film and paper processing machines in which a gear mounted on a transverse drive shaft of a component is readily movable into engagement with a worm gear mounted on a longitudinal shaft and which when in engagement is retained against dislodgement.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
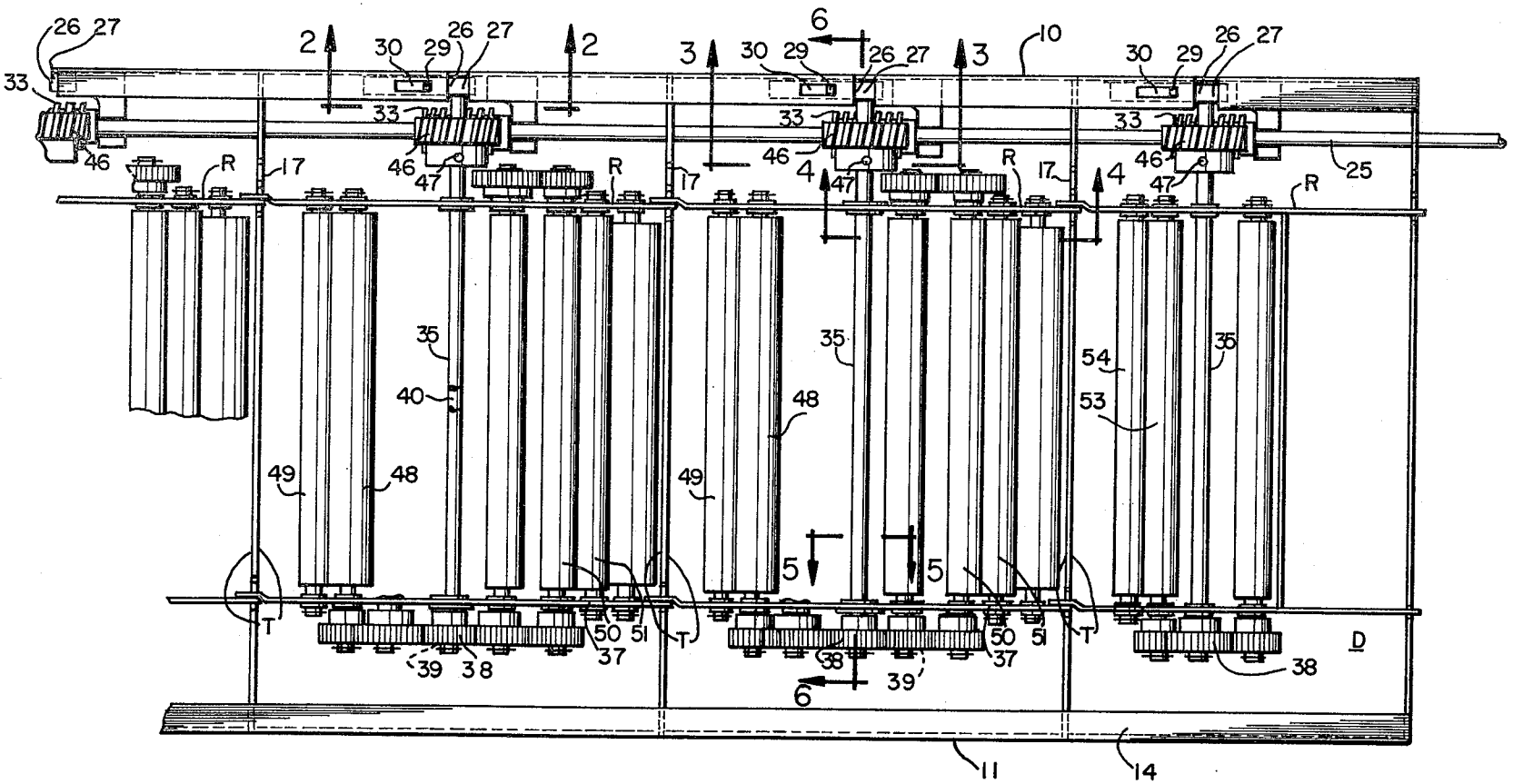
FIG. 1 is a top plan view of a portion of a photographic film and paper processing machine and illustrating the manner of driving the components thereof.
Figure 2:
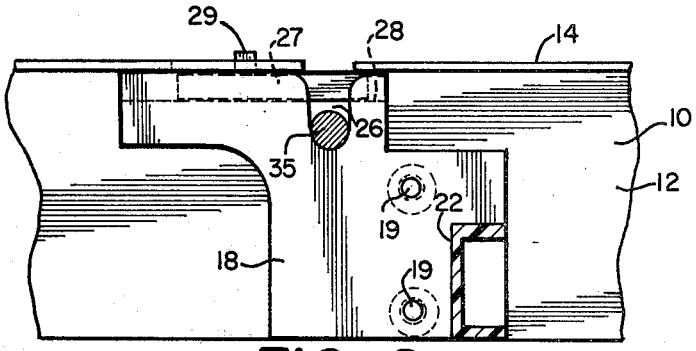
FIG. 2 is an enlarged fragmentary vertical sectional view taken approximately on the line 2—2 of FIG. 1.
Figure 3:
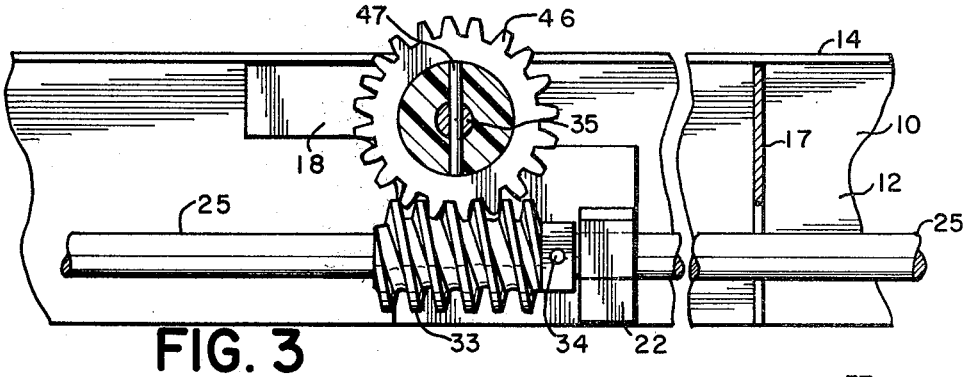
FIG. 3 is an enlarged fragmentary vertical sectional view taken approximately on the line 3—3 of FIG. 1.
Figure 4:
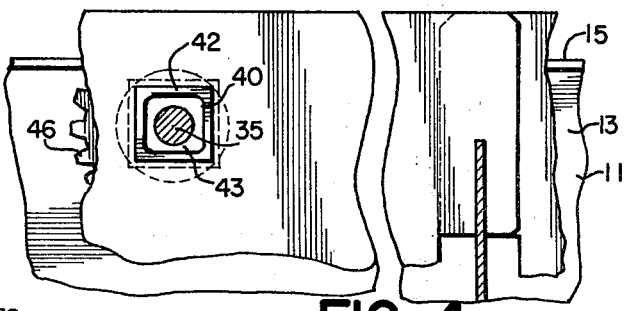
FIG. 4 is an enlarged fragmentary vertical sectional view taken approximately on the line 4—4 of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF A PREFERRED EMBODIMENT

Referring now more particularly to the drawings a portion of a photographic film and paper processing machine is illustrated which includes a pair of spaced horizontal frame rails or beams 10 and 11 which are supported and spaced in any desired manner. The rails 10 and 11 are preferably of non-corrosive metal and are shown as of inverted J-shape in vertical cross section with the central portions 12 and 13 of the rails vertically disposed and the upper flanges 14 horizontally disposed.

At spaced intervals along the rails 10 and 11 horizontally extending vertical support plates 17 are provided which can support and between pairs of which components can be mounted.

A bracket 18 preferably of molded synthetic plastic is provided, secured to the central portion 12 by horizontal screw 19. The bracket 18 has a slot 21 in a forwardly extending arm 22 for receiving the longitudinal drive shaft 25 and a slot 26 in its top margin for purposes to be explained.

A slide plate 27 movable along a groove 28 in the top of the bracket 18 has an upwardly extending lug 29 movable along a slot 30 in the flange 14 for movement of the slide plate 27 to a position closing the top of the slot 26 to a position permitting free access to the slot 26.

Essential components of a photographic film and paper processing machine to which the invention is applicable are liquid tanks for developing, fixing and washing the film or paper. Two processing tanks T are shown. Another important component is a dryer and a dryer is shown at D.

The liquid tanks T each has a roller transport rack R therein, preferably with a turnaround at the bottom. Examples of roller transport racks for processing tanks are shown in U.S. Pat. Nos. 3,532,048; 3,952,610, 4,118,998; and 4,150,589 and of a roller transport rack for a dryer are shown in U.S. Pat. No. 4,135,312, to which the drive of the present invention is applicable with slight modification of the position and mounting of the power input shaft to the rack, as hereinafter described.

The components of the photographic film and paper processing machine, as indicated above, include tanks T and preferably a dryer D and roller transport racks R which racks R require power input shafts.

As shown in the drawings, a longitudinal power input shaft 25 is provided having spaced therealong worm gears 33, one for each transport rack R or for other components to be driven.

Figure 5:
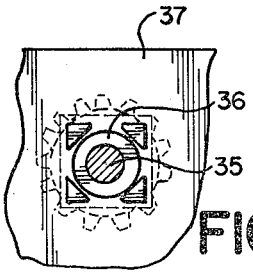
FIG. 5 is an enlarged fragmentary vertical sectional view taken approximately on the line 5—5 of FIG. 1.
Figure 6:
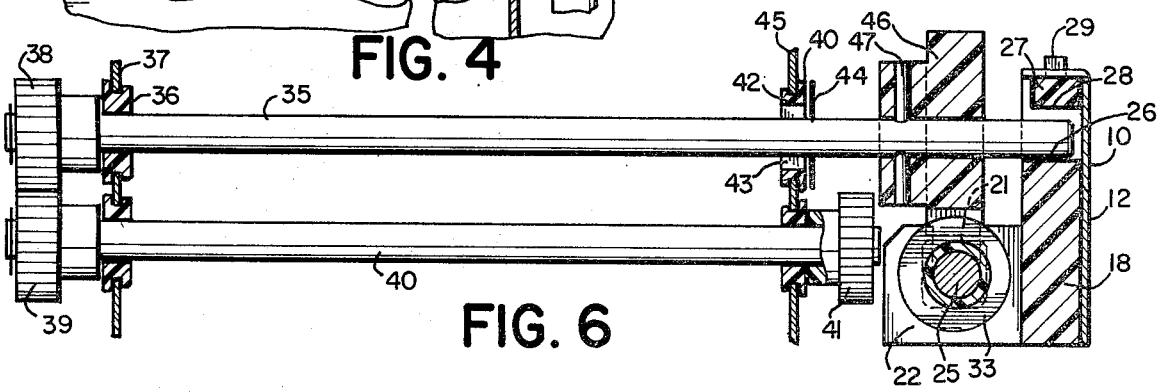
FIG. 6 is a vertical sectional view taken approximately on the line 6—6 of FIG. 1.

Transverse drive shafts 35 are provided, one for each component to be driven. Each of the shafts 35 is flexibly mounted (see FIGS. 5 and 6) in a bearing 36 in the rack frame plate 37 remote from the shaft 25 and has a gear 38 thereon meshing with a gear 39 fixed on a return drive shaft 40 which has a gear 41 thereon at its opposite end. These gears 39 and 41 provide driving gears on both sides of the racks R for the transport rollers of the transport racks R. If the drive is entirely on one side of the rack plate the return shaft 40 will not be required.

Each of the transverse drive shafts 35 at their ends contiguous to the drive shaft 25 extends through a grommet 42 having a large central opening 43 for free movement of the shaft 35 in all directions outside the rack frame plates 45, have gears 46 secured thereto by pins 47, for meshing with an appropriate worm gear 33, the weight of the shaft 35 and its gear 38 and the mounting of the shaft 35 facilitating the gear engagement. The shaft 35 extends beyond the gear 38, is received within the slot 26 and is retained therein by the slide plate 27 which may be moved to uncover the slot 26 for removal of the shaft 35 and the transport rack R which it drives.

The transverse drive shaft 35 for each roller transport, through gear trains of known type driven from the gear 38 through gears 39 and 41 may drive nip or feed rolls 48 and 49 at the entrance of the roller transport, the rolls (not shown) for downward movement, turnaround and upward movement in a manner now available and through nip or feed rolls 50 and 51 at the exit of the roller transport for continuous delivery to the next component.

The dryer D with its entrance nip or feed rolls 53 and 54 is driven in a similar manner for continuous delivery of the photographic film or paper for discharge.

The mode of operation should be apparent from the foregoing. It may be noted that the photograph film or paper delivered to each component is advanced by the roller transports each of which has a transverse power input or drive shaft 35 which is driven by the engagement of its gear 46 with a worm gear 33 on the longitudinal shaft 25 which shaft is driven in any suitable manner such as by an electric motor (not shown).

The gear 46 is normally held engaged with the worm gear 33 by the slide plate 27.

It will also be noted that the worm gear 33 and the gear 46 engaged therewith may be secured at the desired positions by their pins 34 and 47. If it is desired to remove a roller transport rack the slide plate 27 for that component is moved to permit the shaft 35 and the gear 46 thereon to be moved from engagement with its worm gear 33 and the roller transport unit elevated for inspection and maintenance. The roller transport unit can be reinserted by a reversal of the action described.

The drive unit comprising the gear 46 and its shaft 35 by reason of the manner of its mounting remains in operating relation while permitting easy removal and reinsertion.

We claim:

1. In a photographic film and paper processing machine having a plurality of components for successive treating of photographic film and paper, and in which each of the components is provided with a roller transport rack having a plurality of driven web advancing rollers carried in spaced rack frame plates, the improvement which comprises driving means for said roller transport rack, said driving means comprising a first drive shaft having a gear thereon, and a second drive shaft for said roller transport rack transversely disposed with respect to said first drive shaft, said second drive shaft being flexibly mounted at one end in one of said rack plates and having its other end extending through and beyond an enlarged opening in said other of said rack plates for free vertical and horizontal movement of said end of said shaft in a plurality of directions, and beyond said opening having a gear for engagement with the gear on said first drive shaft, said second drive shaft beyond said one of said rack plates having a driving gear for actuating the roller transport rack.

2. The combination defined in claim 1 in which the gear on said first drive shaft is a worm gear.

3. The combination defined in claim 1 in which spaced horizontal frame rails are provided, one of said rails having a bracket thereon with a portion having an opening for positioning said first drive shaft.

4. The combination defined in claim 1 in which spaced horizontal frame rails are provided, one of said rails having a bracket thereon with a slot for the reception of an end of said second drive shaft.

5. The combination defined in claim 4 in which a latch member is provided for retaining said end of said shaft in said slot.

6. The combination defined in claim 4 in which a slidable latch member is provided movable with respect to one of said rails for retaining said end of said shaft in said slot.

7. The combination defined in claim 5 in which an additional drive shaft is provided having gears at each end for driving a roller transport rack, one of said gears being in engagement with said last mentioned gear on said second drive shaft.

8. The combination defined in claim 1 in which one of said components comprises a tank with a roller transport rack therein.

9. The combination defined in claim 1 in which one of said components comprises a dryer with a roller transport rack therein.

* * * * *